United States Patent [19]

Eadon-Allen

[11] 4,333,274

[45] Jun. 8, 1982

[54] MACHINE FOR SMOOTHING AND/OR POLISHING LENS FACES

[75] Inventor: Stuart Eadon-Allen, Birmingham, England

[73] Assignee: Dollond & Aitchison Services Limited, Birmingham, England

[21] Appl. No.: 127,243

[22] PCT Filed: Nov. 13, 1978

[86] PCT No.: PCT/GB78/00039

§ 371 Date: Jul. 11, 1979

§ 102(e) Date: Jul. 11, 1979

[87] PCT Pub. No.: WO79/00285

PCT Pub. Date: May 31, 1979

[51] Int. Cl.[3] ..... B24B 13/00

[52] U.S. Cl. ..... 51/160

[58] Field of Search ..... 51/160, 162, 57, 60, 51/59 R, 157

[56] References Cited

U.S. PATENT DOCUMENTS

| | | | |
|---|---|---|---|
| 1,001,410 | 8/1911 | Johnson | 51/60 |
| 1,973,527 | 9/1934 | DiSanto | 51/160 |
| 2,168,843 | 8/1939 | Lockhart | 51/60 |
| 3,552,899 | 1/1971 | Tagnon | 51/160 |

*Primary Examiner*—Harold D. Whitehead

*Attorney, Agent, or Firm*—Spencer & Kaye

[57] ABSTRACT

A machine for smoothing and/or polishing lenses comprising a holder which is carried on a slide. The slide is guided for movement in two mutually perpendicular directions, both of which are perpendicular to a main axis of the machine. The slide is moved in a plane perpendicular to the main axis along a curved path which results from the combination of two orbital motions produced by cams. One cam is secured to the main shaft and rotary motion is transmitted to the other cam by an element which rotates about the axis of the main shaft and is driven from the main shaft through a transmission means which has a velocity differing from unity.

10 Claims, 4 Drawing Figures

MACHINE FOR SMOOTHING AND/OR POLISHING LENS FACES

BACKGROUND OF THE INVENTION

This invention relates to a machine for smoothing and/or polishing a non-spherical curved face of a lens, which face has a different curvature of different angular positions about an optical axis of the lens. Such a face is referred to herein and in the art as a "cylindrical" face but it will be understood that the term embraces forms which cannot be generated by the rotation about an axis of a straight line which is parallel to that axis.

To smooth and polish a cylindrical lens face, the face is rubbed on a layer of an abrasive on a complementary face of a tool. Relative movement of respective reference axes of the lens and tool must be controlled to avoid changing the curvature of the face of the lens and the relative movement must change throughout the operation to avoid the formation of marks on the face of the lens.

Known machines for smoothing and polishing cylindrical faces of lenses have complex driving means for moving one of the tool and the lens relative to the other in a manner such that the locus of a point on the lens relative to a point on the tool shows little regularity. These known driving arrangements cause abrupt changes of direction of the tool or lens and elements of the driving means undergo rapid changes in velocity. These elements must be robust and accordingly are fairly massive.

During operation, the known machines are subjected to severe vibration which is accompanied by excessive noise and by deterioration of the machine. The inertia of moving parts results in variations between the pressure under which the tool contacts the lens at different places on the face of the lens and these variations in pressure result in changes in the curvature of the lens face. A further disadvantage of the known machines is that the driving means is not capable of controlling relative movement of the reference axes of the tool and lens sufficiently accurately. Inaccuracy in such control also leads to changes in the curvature of the lens face.

SUMMARY OF THE INVENTION

According to a first aspect of the invention, there is provided a machine for smoothing and/or polishing lenses comprising at least one pair of relatively movable holders arranged for holding respective ones of a tool and the workpiece which are to be rubbed together by relative movement of the holders, constraining means for maintaining respective reference axes of the holders parallel to a reference plane and driving means for causing said relative movement of the holders wherein the constraining means comprises a first slide, means for guiding the first slide along a first rectilinear path relative to a body of the machine, a second slide and means for guiding the second slide along a second rectilinear path relative to the first slide, the second path being transverse to the first path.

Preferably, said paths are perpendicular to each other.

According to a second aspect of the invention, There is provided a machine for smoothing and/or polishing lenses comprising at least one pair of relatively movable holders arranged for holding respective ones of a tool and a workpiece which are to be rubbed together by relative movement of the holders, constraining means for maintaining respective reference axes of the holders parallel to a reference plane and driving means for causing said relative movement of the holders, wherein the driving means comprises first and second elements which are rotatable about a main axis at respective different speeds, the first element defining an auxiliary axis offset from the main axis to move around the main axis when the first element rotates and an output element mounted for rotation about the auxiliary axis, the second element being so associated with the output element as to move the output element around the auxiliary axis when the second element moves around the main axis.

The main axis may be fixed with respect to a body of the machine and there may be provided means for connecting one of the holders with the output element for displacement therewith relative to the main axis. The other holder may occupy a fixed position with respect to the main axis and the body of the machine.

There may be provided coupling means for coupling the second element to the output element, the coupling means being adapted for transmitting rotary drive from the second element to the output element and for accommodating relative displacement of the second element and output element radially of the axis about which one of these elements rotates.

The coupling means may comprise a roller which is movable along a slot.

The driving means may include transmission means for transmitting rotary motion between the first element and the second element with a velocity ratio other than unity.

There may be provided a main shaft on which the first element is secured and the transmission means may comprise a lay shaft which is driven from the main shaft and from which drive is transmitted to the second element.

The lay shaft axis is preferably fixed with respect to the main axis.

BRIEF DESCRIPTION OF THE DRAWINGS

One example of an embodiment of the invention will now be described, with reference to the accompanying drawings, wherein.

DESCRIPTION OF A PREFERRED EMBODIMENT

Figure 1:
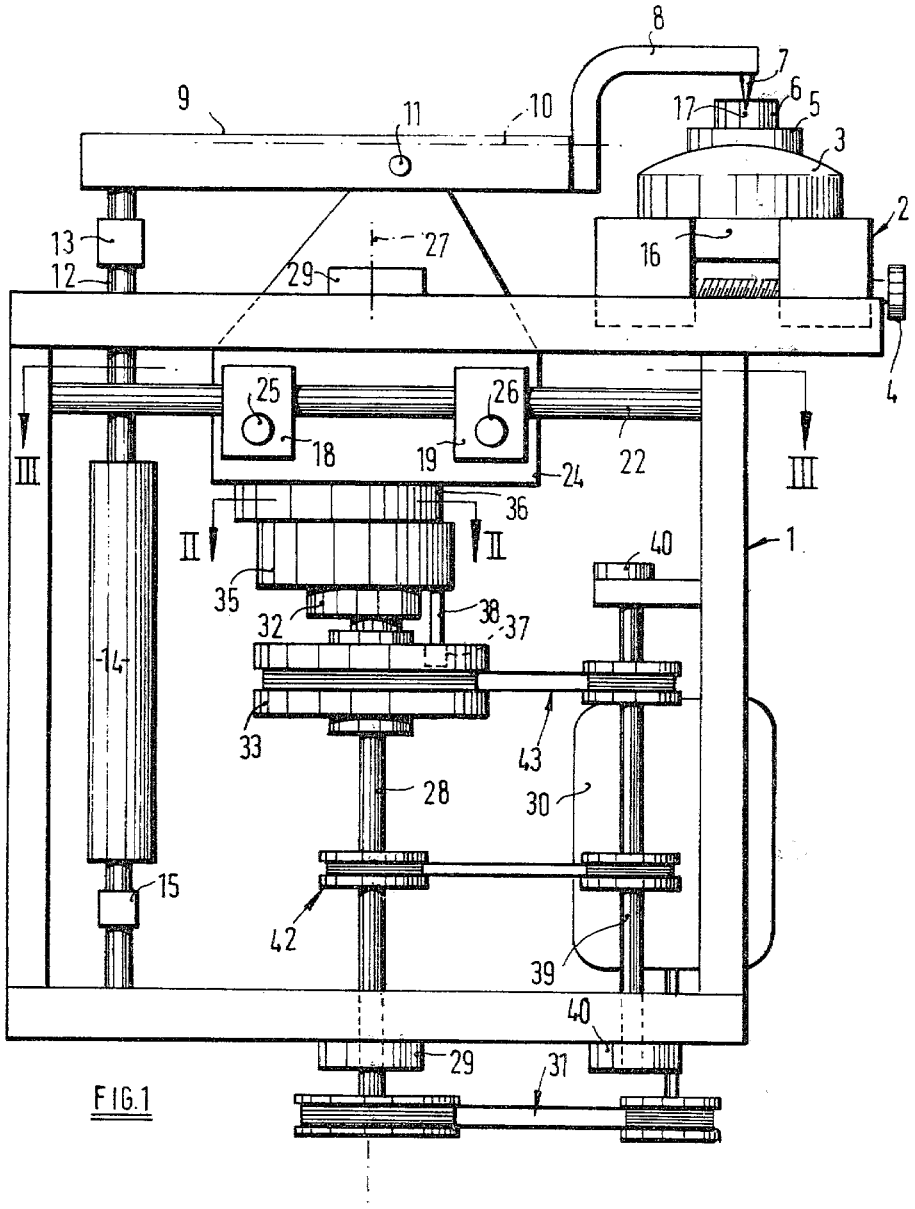
FIG. 1 shows diagrammatically a side elevation of a machine for smoothing and/or polishing a lens face.
Figure 2:
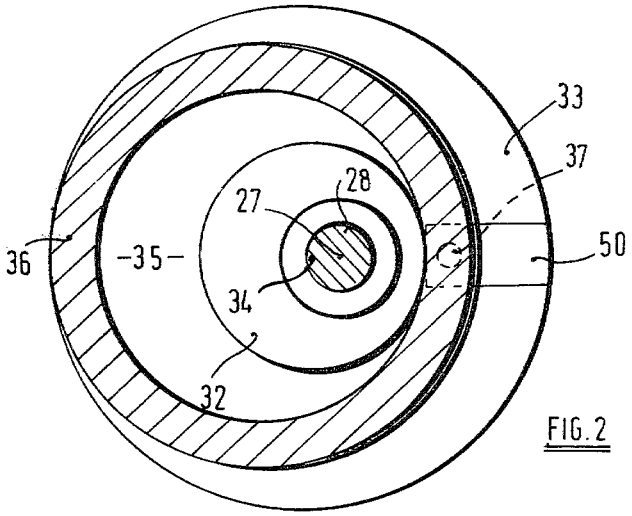
FIG. 2 shows diagrammatically a cross section of certain parts of the machine on the line 2-2 of FIG. 1.
Figure 3:
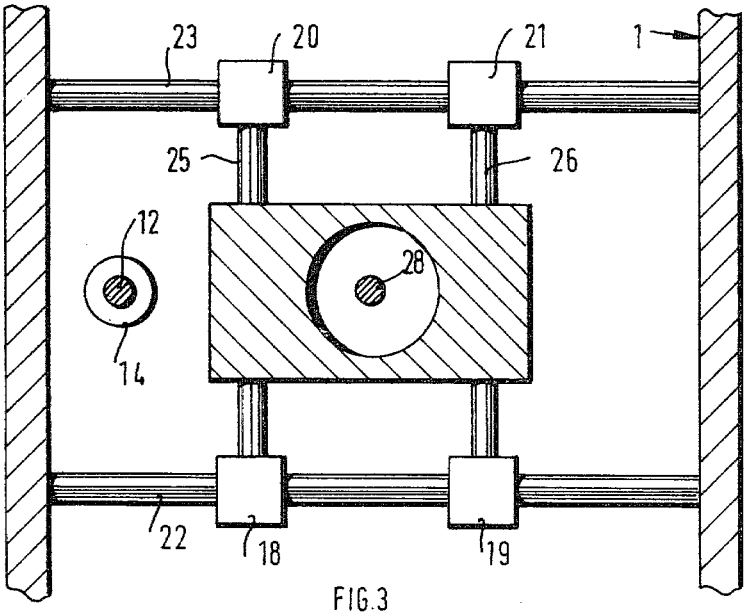
FIG. 3 shows diagrammatically a cross section of further parts of the machine on the line 3-3 of FIG. 1.
Figure 4:
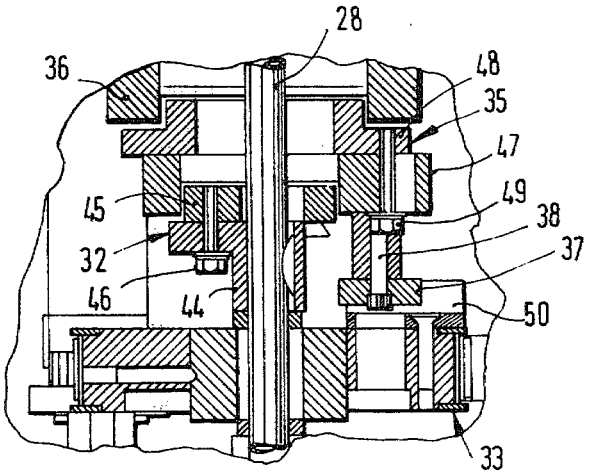
FIG. 4 shows a cross section of the parts shown in FIG. 2 in a plane containing a main axis of the machine.

The machine comprises a body 1 which remains stationary during operation of the machine and may stand on a bench so that the machine is at a convenient height for loading lenses and tools into the machine. On the body, there is provided a vice 2 for holding one of a lens and a tool which are to be rubbed together. In the particular example shown, a smoothing or polishing tool 3 is clamped in the vice and is held thereby in a fixed position relative to the body 1. The vice can be opened by means of a hand wheel 4 for substitution of the tool 3 by a different tool.

On an upwardly facing convex face of the tool 3, there rests a lens 5 having a downwardly facing, concave face which is to be smoothed or polished. On the surface of the lens remote from the tool, there is a metal pallet 6 to which the lens is secured, for example by pitch or by a low-melting point alloy. In an upwardly facing surface of the pallet 6, there are formed two recesses in which there engage a pair of spigots 7. The spigots are provided on a lens holder 8 which is supported on one end of a lever 9 for pivoting movement relative to the lever about a horizontal axis 10 which extends from front to rear of the machine. The lens holder may take various known forms, one of which is that of a yoke.

The lever 9 is supported for pivoting about a horizontal axis 11 which is perpendicular to the axis 10. For urging the lens 5 towards the tool 3 and establishing a predetermined pressure at the interface between the lens and tool, there is provided a piston and cylinder unit whereof the pistion 12 is connected through the intermediary of a universal joint 13 with an end of the lever 9 remote from the lens holder 8. The cylinder 14 of the unit is connected at its end remote from the lever 9 with the body 1 through the intermediary of a further universal joint 15.

The machine further comprises driving means for causing movement of the lens holder 8 relative to the body 1 and the tool 3 in horizontal directions to rub the faces of the lens and tool together, an constraining means for maintaining respective reference axes 16 and 17 of the vice 2 and lens holder 8 parallel to a reference plane. This reference plane is parallel to the opposed surfaces of the jaws of the vice 2 between which the tool 3 is gripped and contains the reference axis of the vice.

The constraining means comprises a set of first slides 18 to 21 and a pair of rectilinear bars 22 and 23 for guiding the first slides along respective rectilinear paths relative to the body 1. The bars 22 and 23 are parallel to each other, are secured to the body 1 and are arranged with their lengths extending from front to rear of the machine. The slides 18 and 19 are slidable along the bar 22 and the bars 20 and 21 are slidable along the bar 23.

The constraining means further comprises a second slide 24 and a pair of rectilinear bars 25 and 26 for guiding the second slide along a rectilinear path transverse to the bars 22 and 23. In the particular example shown, the bars 25 and 26 are perpendicular to the bars 22 and 23. Each of these bars is perpendicular to a main axis 27 of the machine which extends in the same general direction as that in which the vice 2 and lens holder 8 are spaced apart. The bars 25 and 26 are carried by the first slides 18 to 21 for movement therewith. Opposite end portions of the bar 25 are secured in respective apertures in the slides 18 and 20 and opposite end portions of the bar 26 are secured in respective apertures in the slides 19 and 21. The bars 25 and 26 extend through respective apertures in the second slide 24 with a sliding fit. The slide 24 is thus constrained against turning about any axis relative to the body 1 but is free to undergo limited movement relative to the body in all directions perpendicular to the main axis 27.

The pivot by which the lever 9 is supported for pivoting about the axis 11 is carried by and is fixed with respect to the second slide 24 so that the lever 9 can turn relative to the body 1 only about the axis 11 and the lens holder 8 can turn relative to the body only about the axes 10 and 11 which are perpendicular to each other and to the main axis 27. The lens 5 is constrained against turning about the main axis 27 or any axis parallel thereto.

The driving means comprises a main shaft 28 which is supported in bearings 29 on the body 1 for rotation about the main axis 27, the latter being fixed with respect to the body. For driving the main shaft, there is provided a motor 30 having an output shaft which is connected with the main shaft by a belt and pulley drive 31. On the main shaft, there is carried a first element in the form of a cam 32 which is keyed to the shaft for rotation therewith about the main axis 27 and a second element in the form of a pulley 33 which is rotatable about the main axis 27 independently of the main shaft 28.

The periphery of the cam 32 is eccentric with respect to the main axis 27 and defines an auxiliary axis 34 offset from the main axis. An output element in the form of a cam 35 is arranged to rotate about the auxiliary axis, running on the periphery of the first cam 32. Preferably, a ball bearing is interposed between the cams 32 and 35 but this bearing has been omitted from the drawing for clarity of illustration. For transmitting displacement of the output cam 35 to the second slide 24, there is provided a ring 36 which is secured to the second slide and runs on the output cam. Again, a ball bearing is preferably interposed between the cam 35 and the ring 36 but this bearing has been omitted from the drawing for clarity. The interface between the output cam 35 and the ring 36 is eccentric with respect to the auxiliary axis 34. Accordingly, if the output cam 35 is turned about the auxiliary axis it causes the ring 36 and the second slide 24 to be displaced along a circular path relative to the auxiliary axis.

For turning the output cam 35 about the auxiliary axis, there is provided transmission means for transmitting rotary motion from the main shaft 28 to the pulley 33 and coupling means for transmitting that motion from the pulley to the output cam. The coupling means couples the output cam and pulley 33 together for rotary motion but is adapted to accommodate relative displacement of the pulley and output cam radially of the auxiliary axis 34. In the pulley 33, there is formed a radially extending track 50 in which there is engaged a roller 37. The roller is carried on a spindle 38 secured to the output cam 35. If the pulley is rotated about the main axis 27, the roller 37 is carried around that axis and so turns the output cam about the auxiliary axis 34, the roller moving along the track in the pulley towards and away from the auxiliary axis to accommodate the eccentricity of the axes.

The transmission means comprises a lay shaft 39 supported by bearings 40 on the body 1 for rotation about an axis which is fixed relative to the body and is parallel to the main axis 27. A belt and pulley drive 42 is provided for transmitting drive from the main shaft 28 to the lay shaft and a further belt and pulley drive 43 is provided for transmitting rotary drive from the lay shaft to the pulley 33. It will be noted that the pulleys of the drives 31, 42 and 43 each rotates about a respective axis which is fixed relative to the body 1 so that there is no variation in the tension of the drive belts during operation of the machine.

The respective velocity ratios of the belt and pulley drives 42 and 43 are such that the overall velocity ratio of the transmission means differs from unity. The speed of rotation of the pulley 33 is less than that of the first cam 32. We have found that a transmission means having a velocity ratio of 416:19 gives satisfactory results.

As the main shaft 28 rotates, the auxiliary axis 34 is carried around the main axis 27 by the first cam 32. This motion is transmitted through the output cam 35 to the ring 36 and the second slide 24. An additional, but slower, rotary motion is applied to the ring 36 and slide 24 by rotation of the output cam 35 about the auxiliary axis 34, in the manner previously described. The motion of the slide 24 is therefore the resultant of combining two circular motions of different frequency and the lens holder 8 executes a corresponding motion relative to the vice 2. Because the motion is produced by combining continuous rotary motions, neither any element of the driving means nor the lens 5 is subjected to abrupt changes of direction or rapid changes in velocity.

A further advantage provided by the fundamentally rotary motion produced by the machine described, as compared with the fundamentally reciprocating motions provided in known machines, is that a greater degree of rubbing is produced by a circular motion of given throw than is produced by a reciprocating motion of the same throw. This enables a relatively small throw to be used in the machine described and this enables proper contact to be maintained between the lens and tool with rocking of the lens about the axis 10 and rocking of the lens about an axis defined by the spigots 7 through only relatively small angles.

If a single machine is to be used on different occasions for smoothing and for polishing lenses, then we prefer that the eccentricity of the first cam 32 and the eccentricity of the output cam 35 should be adjustable. We have found that good results are achieved if, for smoothing, the eccentricity of the first cam 32 is 33 mm and the eccentricity of the output cam 35 is 10 mm. For polishing, we have found that a first cam with an eccentricity of 57 mm and an output cam with an eccentricity of 10 mm provides good results.

To enable the eccentricity of the first cam 32 to be adjusted, this cam is formed in two parts, namely an inner part 44 and an outer part 45. The inner part 44 is keyed to the main shaft 28 and the outer part 45 is releasably clamped to the inner part by a clamping screw 46. When the clamping screw is slackened, the outer part can be adjusted relative to the inner part about an axis which is offset from the main axis 27 to adjust the eccentricity of the periphery of the first cam relative to the main axis.

Similarly, the output cam 35 is formed in two parts, namely a lower part 47 and an upper part 48. The lower part 47 runs on the first cam 32 and carries the spindle 38. The ring 36 runs on the upper part 48 and the parts 47 and 48 are releasably clamped together by a clamping screw 49. When the clamping screw is slackened, the eccentricity of the ring 36 with respect to the auxiliary axis 34 can be adjusted. The range of adjustment of the cams 32 and 35 is limited by the respective forms of the components of these cams so that it is not possible to set the machine in a condition in which a moving part of the machine will foul some other part of the machine during operation.

Industrial applicability:

The driving means and constraining means of the machine combine to cause the lens 5 to move smoothly relative to the tool 3 along a curved path which has no abrupt changes of direction, brings about a relatively large amount of rubbing contact between all parts of the lens face and the tool and controls the relative movement so that the reference axis 17 of the lens is maintained in the reference plane containing the reference axis 16 of the tool. Although the machine is especially useful for smoothing and polishing cylindrical faces of lenses, both convex and concave faces, the machine is also useful for smoothing and polishing part-spherical faces of lenses.

As in known machines for smoothing and polishing lenses, there may be provided means for feeding a slurry of abrasive particles in a liquid collant to the interface between the lens 5 and the tool 3 and there may further be provided a housing in which the vice 2, tool 3 lens 5 and lens holder 8 are disposed. Such housing would prevent the abrasive slurry being thrown away from the machine and would enable the slurry to be collected and re-used in a known manner. Since the housing and slurry feed means form no part of the present invention, they have been omitted from the accompanying drawings and will not be more particularly described.

I claim:

1. A machine for smoothing and/or polishing lenses comprising at least one pair of relatively movable holders arranged for holding respective ones of a tool and a workpiece which are to be rubbed together by relative movement of the holders, constraining means for maintaining respective reference axes of the holders parallel to a reference plane and driving means for causing said relative movement of the holders characterised in that the driving means comprises first and second elements which are rotatable about a main axis at respective different speeds, the first element defining an auxiliary axis offset from the main axis to move around the main axis when the first element rotates and an output element mounted for rotation about the auxiliary axis, the second element being so associated with the output element as to move the output element around the auxiliary axis when the second element moves around the main axis.

2. A machine according to claim 1 further characterised in that the main axis is fixed with respect to a body of the machine and there is provided means connecting one of the holders with the output element for displacement therewith relative to the main axis.

3. A machine according to claim 1 or claim 2 further characterised by means for coupling the second element to the output element, the coupling means being adapted for transmitting rotary drive from the second element to the output element and for accommodating relative displacement of the second element and the output element radially of the auxiliary axis.

4. A machine according to claim 3 further characterised in that the coupling means comprises a roller movable along a slot.

5. A machine according to claim 2 further characterised by the provision of transmission means for transmitting rotary motion from the first element to the second element with a velocity ratio differing from unity.

6. A machine according to claim 5 further characterised by a main shaft on which the first element is secured and by a lay shaft comprised by the transmission means, there being provided first drive means for transmitting rotary drive from the main shaft to the lay shaft and second drive means for transmitting rotary drive from the lay shaft to the second element.

7. A machine according to claim 6 further characterised in that the lay shaft is supported by bearings for rotation about an axis which is fixed with respect to the axis of the main shaft.

8. A machine according to claim 1 or claim 2 further characterised in that the constraining means comprises a first slide, means for guiding the first slide along a first rectilinear path relative to the body of the machine, a second slide and means for guiding the second slide along a second rectilinear path relative to the first slide, the second path being transverse to the first path.

9. A machine according to claim 8 further characterised in that said first and second paths are each perpendicular to the main axis.

10. A machine according to claim 1 wherein the main axis and the auxiliary axis are substantially parallel.

* * * * *